US009931767B2

(12) United States Patent
Balcells

(10) Patent No.: US 9,931,767 B2
(45) Date of Patent: Apr. 3, 2018

(54) FRAME FOR AN ELECTRIC APPARATUS FOR CUTTING CERAMIC ELEMENTS

(71) Applicant: GERMANS BOADA, S.A., Barcelona (ES)

(72) Inventor: Jordi Soler Balcells, Rubi (ES)

(73) Assignee: GERMANS BOADA, S.A., Barcelona (ES)

( * ) Notice: Subject to any disclaimer, the term of this patent is extended or adjusted under 35 U.S.C. 154(b) by 58 days.

(21) Appl. No.: 14/735,314

(22) Filed: Jun. 10, 2015

(65) Prior Publication Data

US 2015/0360391 A1 Dec. 17, 2015

(30) Foreign Application Priority Data

Jun. 11, 2014 (ES) ..... 201430892

(51) Int. Cl.

| | |
|---|---|
| ***B25H 1/00*** | (2006.01) |
| ***B28D 1/22*** | (2006.01) |
| ***B28D 1/04*** | (2006.01) |
| ***B28D 7/04*** | (2006.01) |
| *B28D 7/02* | (2006.01) |

(52) U.S. Cl.
CPC ..... *B28D 1/225* (2013.01); *B25H 1/0042* (2013.01); *B28D 1/044* (2013.01); *B28D 7/04* (2013.01); *B28D 7/02* (2013.01); *Y10T 83/96* (2015.04)

(58) Field of Classification Search
CPC ..... B25H 1/0042; B28D 1/044; B28D 7/04; B28D 7/02; B28D 1/225; B28D 1/224; B28D 1/22; B28D 1/226; B28D 1/228; B28D 1/327; B28D 1/223; Y10T 83/96
See application file for complete search history.

(56) References Cited

U.S. PATENT DOCUMENTS

| | | | | |
|---|---|---|---|---|
| 6,439,218 | B1 * | 8/2002 | Hulett | B27B 27/02 125/11.22 |
| 7,140,361 | B1 * | 11/2006 | Chao-Huan | B23D 45/024 125/13.01 |
| 2008/0277324 | A1 * | 11/2008 | Meyers | E03F 5/0408 210/164 |
| 2009/0146353 | A1 * | 6/2009 | Hashim | A47J 47/005 269/13 |
| 2009/0273130 | A1 * | 11/2009 | Armstrong | B25B 5/127 269/16 |
| 2012/0118278 | A1 * | 5/2012 | La Banco | B23D 47/025 125/35 |

* cited by examiner

*Primary Examiner* — Jonathan Riley
*Assistant Examiner* — Liang Dong
(74) *Attorney, Agent, or Firm* — Baker and Rannells, P.A.

(57) ABSTRACT

Frame for an electric apparatus for cutting ceramic elements preferably manufactured by a drawing and punching process starting from a metallic plate, being the frame a unique and continuous part in which one or more lined up going through grooves are arranged along which the cutting disc is movable to carry out the cutting of the ceramic tiles, having one or more bulgings directed in a convex form towards the interior part of the frame, being arranged in each of them a first orifice for draining out the water for cooling the cutting disc, second and third bulgings of the metallic plate being aimed at attachment means and abutment means for foldable legs and first bulgings for joining of the guide supporting and leading the cutting disc.

4 Claims, 2 Drawing Sheets

FRAME FOR AN ELECTRIC APPARATUS FOR CUTTING CERAMIC ELEMENTS

OBJECT OF THE INVENTION

The object of this invention is a frame made in one unique part which is specially designed to form the bed to receive the rest of elements and devices of an electric cutting apparatus such as a bridge like guide to support and guide the cutting disc and its corresponding driving motor as well as the legs supporting the frame.

BACKGROUND OF THE INVENTION

It is well known that common tiles and glazed tiles are widespread in the building industry and in public works for covering floors and walls. For its installation it is necessary in many cases to cut the pieces to adapt the tiles or glazed tiles to the forms needed, the cutting operations being made by means of hand or electric driven cutting apparatus for ceramic tiles.

The electric cutting apparatus correspond mainly to two different types, i. e. those in which the disc is mounted on the lower side of the frame and it is fixed in its position, for which reason the cutting action is performed by moving the ceramic element, and the types in which the disc is located on a bridge like guide located over the top side of the frame, to support and guide the cutting disc and the driving electric motor. In this tile cutting apparatus the ceramic element is fixed and the disc is movable.

In electric cutting apparatus, the surface to support the ceramic element is usually formed by two or more parts in order to make the cleaning and maintenance easier, having in its lower part a container aimed at collecting the water used for cooling the disc. As the support surface is made out of two or more parts a frame is required to obtain the necessary rigidity, for which reason the cost and weight of the cutting apparatus increase in a substantial extent, making as well difficult and complicate the transport of the apparatus to the site of utilisation.

The frame for electric cutting apparatus for ceramic tiles which is the object of the present invention solves the above problems, being made out of a unique part to which the rest of elements and devices are incorporated, among others, the guide for the cutting discs and the supporting legs.

DESCRIPTION OF THE INVENTION

The frame for an electric apparatus for cutting ceramic elements which is the object of this invention consists in a unique and continuously shaped part, having said frame approximately the form of a straight paralelepipedic body with a rectangular base, open by its lower side, such that on the top side of the straight paralelepipedic body the following elements are arranged:

a. one or more going through grooves of the same width, the axis of each of said grooves being located on the same straight line parallel to the long sides of the upper base, being the sum of the lengths of the first going through grooves less than the length of the longest side of the upper base; being the rectangular surfaces of the same width than the going through grooves and being located between the adjacent ends of said going through grooves, being directed in a convex form towards the internal part of the frame and being arranged preferably in the bottom of each of said rectangular surfaces a first orifice;

b. a plurality of bulgings directed in a convex form towards the interior part of the frame, uniformly located on the upper base, with a through going orifice being located on the bottom of each of said bulgings;

c. first bulgings directed in a convex form towards the external part of the frame, located at one side of the longitudinal grooves and such that the straight line joining them is parallel to the longitudinal axis of said longitudinal groove, being arranged in each of said bulgings first movable means attached to the supports of the guide for the slide bearing the cutting disc;

d. a plurality of second going through orifices arranged within a rectangle with sides parallel to the sides of the upper base, being the length and width of said rectangle less than the length and width of the upper base;

e. four second bulgings directed in a convex form towards the external part of the frame and suitably located in first vertical parallel sides of the frame, and f. four third bulgings directed in a convex form towards the interior of the frame and suitably arranged in second vertical sides, in which second attachment means articulated to the a legs of the frame are arranged.

LIST OF REFERENCES

Figure 1:
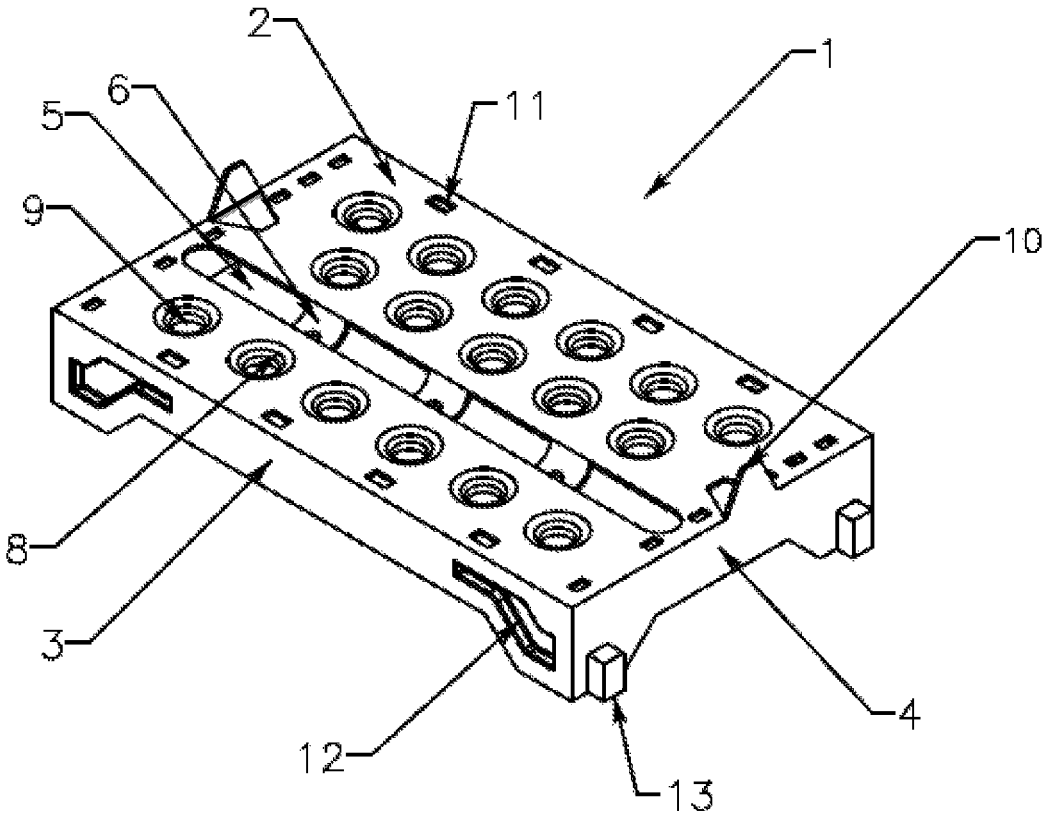
FIG. 1 is a perspective view from the upper side of the frame for an electric cutting apparatus for ceramic elements according to the invention.

1 frame for an electric apparatus for cutting ceramic elements
2 upper base
3 first vertical sides
4 second vertical sides
5 longitudinal grooves
6 rectangular surface
7 first orifice
8 bulging
9 second orifice
10 first bulging
11 second orifice
12 second bulging
13 third bulging

PREFERRED EMBODIMENT OF THE INVENTION

Figure 2:
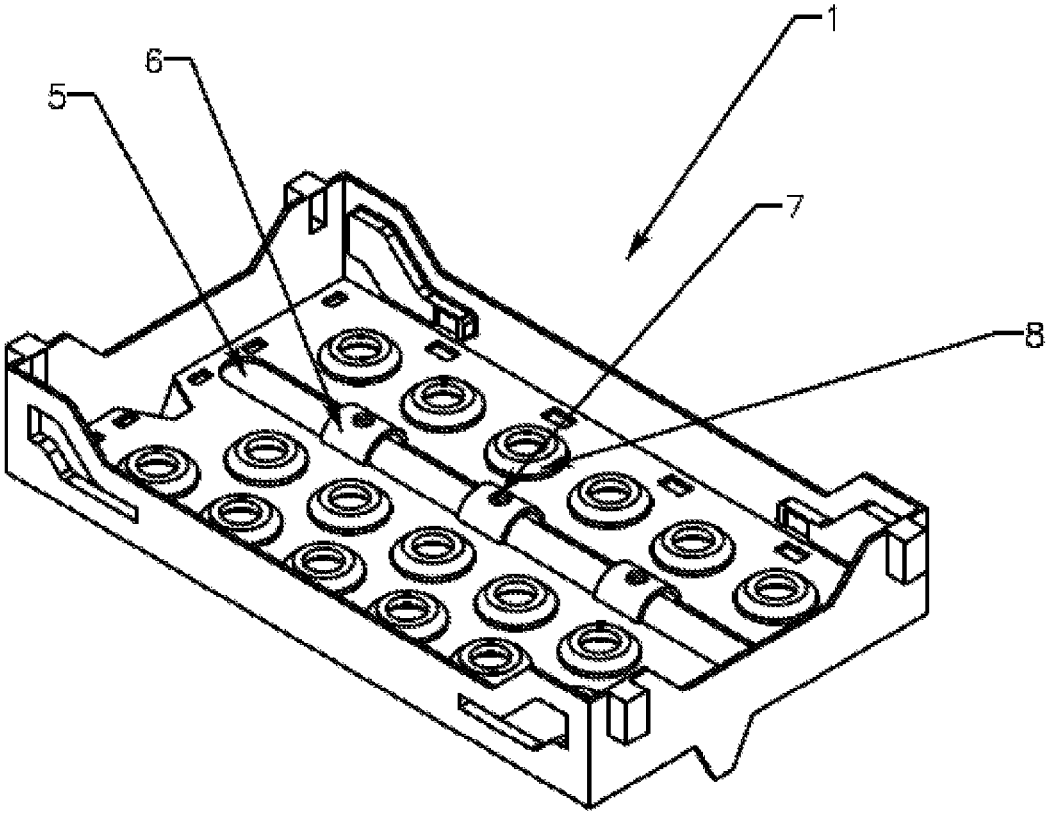
FIG. 2 is a perspective view from the lower side of the frame for the electric cutting apparatus for ceramic elements of FIG. 1.

FIGS. 1 and 2 show two different perspective views of the frame 1 for an electric apparatus for cutting ceramic elements, being shown in FIG. 1 a perspective view from the upper side and in FIG. 2 a perspective view from the lower side of the frame.

On the upper base 2 some longitudinal lined up grooves 5 have been arranged, being the rectangular surfaces 6 remaining between the adjacent ends of said longitudinal grooves directed in a convex form towards the interior part of the frame so as to define a channel in which the cutting disc is partially introduced during operation, said cutting disc moving along guided by a bridge-like guide supporting the same. In each of said rectangular surfaces, a first orifice 7 may be located for draining out the cooling water for the cutting disc.

Multiple bulgings 8 directed in a convex form towards the interior of the frame are located uniformly distributed on the upper base. In the bottom of each of said bulgings a second going through orifice 9 is arranged to drain out the cooling water so that said second orifices will improve the draining of water, eliminating the need to arrange other blind grooves for guiding the water to the second orifices, so that the manufacturing process is more economic.

The cutting disc with its driving electric motor, commands and controls, as well as the nozzle for refrigeration water are arranged on a bridge-like support attached to the frame by first movable fixation means which permit the assembly and disassembly of the disc, said fixation means being arranged on first bulgings 10. In this preferred embodiment, the first bulgings are a portion of the upper base punched out and bent in an approximately perpendicular form to said upper base in an direction towards the external part of the frame.

For the fixation and location of the ceramic elements to be cut in an adequate position a plurality of second orifices 11 are arranged to receive positioning and fixation stops, for instance for the tiles to be cut.

This type of electric cutting apparatus usually have foldable legs attached to the frame in second bulgings 13 arranged in the first vertical sides 3, being arranged in each of them second fixation means, for instance a shaft on which the legs can rotate. In order that the legs remain fixed in its extended or folded position, third bulgings 12 are arranged in the second vertical sides 4, having a stop function when the legs are extended.

The preferred method to manufacture the object of the invention is by drawing and punching a metallic plate.

This frame for an electric cutting apparatus for ceramic elements is easy to clean as it is made in a unique part, its maintenance being also easy and since it is made in form of a unique and continuous part its rigidity is suitable to reduce weight and manufacturing costs.

The invention claimed is:

1. A frame for an electric apparatus for cutting ceramic elements comprising; wherein the frame having an approximate form of a rectangular parallelepipedic body open at a lower side-thereof, said rectangular parallelepipedic body having a rectangular upper base, first vertical parallel sides and second vertical parallel sides, wherein said frame is formed from a metal plate, the frame defining:

i. multiple going through grooves on a top side of said rectangular parallepipedic body having a same width, an axis of each of said going through grooves being located on a same straight line parallel to long sides of said rectangular upper base, a sum of lengths of the going through grooves being less than a length of a longest side of the rectangular upper base;

ii. rectangular surfaces being located between adjacent ends of said going through grooves; said rectangular surfaces having a same width as the going through grooves and being a part of said metal plate directed in a convex form towards an internal part of the frame connecting two opposed sides of a channel defined on the frame, wherein each rectangular surfaces has an additional drain going through orifice;

iii. a plurality of drain bulgings uniformly located on the upper base and directed in a convex form towards said internal part of the frame, with a drain going through orifice being located on a bottom of each of said plurality of drain bulgings;

iv. first bulgings located at one side of the longitudinal grooves and directed in a convex form towards an external part of the frame, a straight line joining said first bulgings being parallel to a longitudinal axis of said going through grooves, each of said first bulgings being attachable to a-supports of a guide slide bearing a cutting disc through a movable first attachment means attached to said supports; and, v. a plurality of positioning going through orifices arranged as a rectangle, said rectangle having sides parallel to the first and second vertical parallel sides of the rectangular upper base, a length and width of said rectangle being less than a length and width of the rectangular upper base.

2. The frame for an electric apparatus for cutting ceramic elements, according to claim 1, further comprising; the first bulgings are a portion of the upper base in a substantially perpendicular disposition with respect to the upper base and directed towards the external part of the frame.

3. The frame for an electric apparatus for cutting ceramic elements, according to claim 1, further comprising; wherein second bulgings are directed in a convex form towards the external part of the frame and located in said first vertical parallel sides of the frame for receiving foldable legs of an electric cutting apparatus.

4. A frame for an electric apparatus for cutting ceramic elements comprising; wherein the frame having an approximate form of a rectangular parallelepipedic body open at a lower side thereof, said rectangular parallelepipedic body having a rectangular upper base, first vertical parallel sides and second vertical parallel sides, wherein said frame is formed from a metal plate, the frame defining:

i. multiple going through grooves having a same width on a top side of said rectangular parallelepipedic body, an axis of each of said going through grooves being located on a same straight line parallel to long sides of said rectangular upper base, a sum of lengths of the going through grooves being less than a length of a longest side of the rectangular upper base;

ii. rectangular surfaces being located between adjacent ends of said going through grooves; said rectangular surfaces having a same width as the going through grooves and being part of said metal plate directed in a convex form towards an internal part of the frame, wherein each rectangular surfaces has an additional drain going through orifice;

iii. a plurality of drain bulgings uniformly located on the upper base and directed in a convex form towards said internal part of the frame, with a drain going through orifice being located on a bottom of each of said plurality of drain bulgings;

iv. first bulgings located at one side of the going through grooves and directed in a convex form towards an external part of the frame, a straight line joining said first bulgings being parallel to a longitudinal axis of said going through grooves, each of said first bulgings being attachable to a-supports of a guide slide bearing a cutting disc through a movable first attachment means attached to said supports;

v. a plurality of positioning going through orifices arranged as a rectangle, said rectangle having sides parallel to the first and second vertical parallel sides of the rectangular upper base, a length and width of said rectangle being less than a length and width of the rectangular upper base;

vi. second bulgings are directed in a convex form towards the external part of the frame and located in said first vertical parallel sides of the frame, first attachment means being arranged in said second bulgings for attachment of electric cutting apparatus legs; and vii. third bulgings directed in a convex form towards the internal part of the frame and arranged in said second vertical sides, second attachment means being arranged in said third bulgings for attachment of electric cutting apparatus legs.

* * * * *